United States Patent [19]

Turner et al.

[11] Patent Number: 5,064,349

[45] Date of Patent: Nov. 12, 1991

[54] METHOD OF MONITORING AND CONTROLLING A PUMPED WELL

[75] Inventors: John M. Turner, Floria Vista; Jan L. Nethers, Farmington; Robert M. Knight, Santa Fe, all of N. Mex.

[73] Assignee: Barton Industries, Inc., Shawnee, Okla.

[21] Appl. No.: 483,917

[22] Filed: Feb. 22, 1990

[51] Int. Cl.[5] ..... F04B 49/02

[52] U.S. Cl. ..... 417/53; 417/12; 417/20; 417/36; 417/44

[58] Field of Search ..... 417/18, 36, 44, 20, 417/12, 53

[56] References Cited

U.S. PATENT DOCUMENTS

| | | | |
|---|---|---|---|
| 3,559,731 | 2/1971 | Stafford | 417/12 |
| 3,851,995 | 12/1974 | Mills | 417/18 |
| 4,507,055 | 3/1985 | Fair et al. | 417/53 |
| 4,594,665 | 6/1986 | Chandra et al. | 417/18 |
| 4,631,954 | 12/1986 | Mills | 417/18 |

*Primary Examiner*—Richard A. Bertsch
*Assistant Examiner*—David W. Scheuermann
*Attorney, Agent, or Firm*—Head & Johnson

[57] ABSTRACT

A method of monitoring and controlling a pumped well having a rod string extending from a pumping unit located at the earth's surface to a subterranean pump, the rod string being sequentially reciprocated through up and down strokes and the well producing pumped fluid through a collection pipe, the method includes measuring the displacement and the load on the rod string, determining the well is pumped-off when fluid flow from the well substantially stops, recording the maximum load on the sucker rod string during pumped-off conditions, the load being measured during a selected portion of the first portion of the rod string downstroke, establishing a target pumped-off load as a selected percentage of the measured load, periodically initiating a pumping cycle, terminating each pumping cycling when the rod load equals the target rod load. The well is pumped in cycles with each pumping cycle terminated as above described and in which the time spacing between pumping cycles is selected by the well fill-time determined by measuring the rod load during a portion of the first portion of a downstroke following each of a succession of short pauses in the pumping action until the measured rod load approaches the point where it is substantially stabilized, indicating the fluid level in the well is near an equilibrium point, which measured fill-time is then thereafter used as the delay time between each pumping cycle.

9 Claims, 11 Drawing Sheets

METHOD OF MONITORING AND CONTROLLING A PUMPED WELL

SUMMARY OF THE INVENTION

When the typical oil well is first drilled formation pressure is usually sufficient to force fluid, that is, crude oil and associated water to the surface. The well is said to flow—that is, produce fluid without requiring any pumping action. However, in most areas of the world the formation pressure ultimately dissipates, and thereafter to extract oil from a subterranean formation it is necessary to pump the oil to the earth's surface.

Various types of pumping systems are employed, however, the most common type utilizes a string of sucker rods extending within tubing in the well bore. At the lower end of the tubing there is a reciprocated pump. At the earth's surface a pumping unit is used to reciprocate the rod string. While pumping units may take different forms, the typical pumping unit employs a pivoted walking beam with a horse head at the outer end. A cable is attached to the horse head, and the cable is then attached to the rod string. Pivotation of the walking beam is used to produce reciprocal motion of the sucker rod string and thereby reciprocation of the pump at the bottom of the well. Valving systems with the pump cause fluid from the producing formation to be drawn into the lower end of the tubing string and forced upwardly in the tubing string to the earth's surface.

The typical oil bearing formation is formed of porous rock. A vertical borehole penetrating such formation constitutes a relatively small cross-sectional area of the entire crude oil bearing porous rock formation. Seepage of crude oil from a porous rock formation into a borehole is a fairly slow process. For this reason, the typical oil well is pumped in cycles. That is, the well is first pumped for a selected length of time sufficient to pump the fluid accumulated in the well bore to the earth's surface. Once the fluid accumulated in the well bore has been pumped out, a fill-time must be provided to allow more fluid to seep from the formation into the borehole. As fluid migrates through the porous formation, a fluid level in the well bore is slowly reached at which equilibrium is established, after which no further fluid flows into the well bore regardless of any additional length of time allowed. After the well bore is filled or near filled with fluid to the equilibrium point, another pumping cycle is started.

It can easily be seen therefore that for economy of operation, it is important for the producer to know two basic facts. First, the producer needs to know how long the well should be pumped, once pumping action is started, to extract the fluid accumulated in the well bore. Obviously, if the pumping action is stopped prematurely, fluid will be left in the well bore, thereby diminishing the overall production of the well. On the other hand, if pumping action continues after the fluid which has accumulated in the well bore has been pumped to the earth's surface, (which is commonly referred to as the "pumped-off" condition) the result is substantially increased wear and tear on the equipment as well as waste of energy required to provide the pumping action. For these reasons, it is exceedingly important that the well be operated in such a way that when a pumping cycle is initiated, it is thereafter terminated when the well has been pumped-off, and that the pumping action is never terminated prematurely or continued after the well is pumped-off. A fundamental concept of the present disclosure is a method of accurately determining well pump off.

The second important factor in efficiently and economically operating a pumped well is that of determining, after a pumping cycle has been completed, that is, after a well has been pumped-off, when to start the next pumping cycle. The time lapse between the termination of one pumping cycle and the start of another is referred to as the "fill-time". If the well is operated in such a way that a pumping cycle is started prematurely, that is, before the well borehole has filled as at least substantially filled to the equilibrium, then the result will be that pumping cycles will be more frequent than necessary. Maximum stress is placed on pumping equipment during the initiation of each pumping cycle, that is, when the pumping equipment changes from rest condition to pumping action, and for this reason it is desirable, from the standpoint of equipment wear and tear, that the pumping cycles be kept to a minimum while, at the same time, the cycles must be arranged such that the maximum well fluid is produced. Therefore, it is undesirable to operate a well so that the pumping cycles are initiated too frequently, that is, without allowing the fluid level in the borehole to first reach equilibrium or near equilibrium state before pumping actions are started.

On the other hand, if the well is operated in such a way that the borehole is filled to equilibrium and the next pumping cycle is not immediately started, then the total production capacity of the well is not being utilized. It is easy to see that for maximum efficiency and production of fluid from a well, the fill-time must be accurately determined so that the pumping cycles are not repeated more often than necessary and, most particularly, so that pumping cycles are initiated with the time delay between each cycles being no longer than that necessary for the well to fill to equilibrium.

An additional problem encountered in producing oil wells is that pumping cycle times and fill-times are not static. Due to changes which take place in underground formations, for reasons that are not fully understood but which may be related to barometric pressure, moon phase (that is the change in gravitational situations caused by different positions of the moon relative to the earth) and for other reasons, the required fill-time changes. For maximum productivity and minimum costs, it is necessary to frequency recalibrate the fill-time required between pumping cycles. Up to the present time no highly efficient and effective means has been commonly employed in the petroleum industry for determining fill-time and for sequentially and automatically updating the fill-time used to control pumping cycles. It is, therefore, a primary object of the present disclosure to provide an improved means of controlling a pumped well so that the well pumping cycle is properly terminated when the well is pumped-off and most importantly, so that the fill-time between pumping cycles is accurately determined, and so that the fill-time is frequently and automatically updated.

Others have provided disclosures relating to the operation of pumped wells, for determining when a well is pumped-off and for determining other features used in well pumping programs. For reference to such teachings see the following patents: U.S. Pat. Nos. 3,951,209; 4,487,061; 4,483,188; 4,509,901; 4,594,665; 4,551,730; 4,561,299; 4,622,635; 4,363,605; 3,343,409; 3,824,851;

3,851,995; 3,998,568; 4,102,394; 4,143,546; 4,286,925; 4,302,157; 3,306,210; 3,817,094; 4,015,469 and 4,034,808.

The present disclosure relates to a method of monitoring a pumped well having a rod string extending in a borehole from a pumping unit located at the earth's surface to a subterranean pump. The rod string is sequentially reciprocated through up and down strokes by a pumping unit. The reciprocated pump forces fluid upwardly in the tubing string from the subterranean formation to the earth's surface, and the produced fluid flows out of the tubing string through a collection pipe. The displacement of the rod string is measured, such as by measuring the angle of inclination of the typical pumping unit walking beam (beam angle). In addition, the load on the rod string is measured, such as by means of a load cell. The flow of fluid through the collection pipe is monitored to determine when the flow has stopped, or substantially stopped, to indicate the well pumped-off condition.

When a pumping cycle has been initiated, the pumping unit is operated until a pumped-off condition is detected. The maximum load on the sucker rod string is measured during a selected portion of the first portion of the downstroke of the sucker rod string during pumped-off condition and this maximum load is recorded. A target pumped-off sucker rod string load is automatically calculated as a selected percentage of the detected load during pumped-off conditions.

Thereafter, the well is pumped by periodically initiating pumping cycles and continuing the pumping cycles while measuring the load on the rod string through the same selected portion of the first portion of each downstroke. When such measured load equals or exceeds the established target pumped-off load, the well is considered to be pumped-off, and the pumping cycle is terminated.

The term "pumped-off" does not mean when every possible drop of fluid has been pumped from a borehole. Instead, "pumped-off" means when substantially all the fluid has been pumped out and the fluid level has dropped to the point that further pumping action is no longer economically desirable.

In addition to the important steps of stopping a pumping cycle when the well is pumped-off, another equally important which must be incorporated in an effective method of monitoring and controlling a pumped oil well is that of determining the well fill-time. The "fill-time" is the time elapse required between the termination of one pumping cycle and the start of another. In the past, fill-time has usually been selected by well operators based on empirical information. By and large, fill-time for wells has not been accurately known, nor has any good system for determining fill-time been universally practiced in the oil industry. More importantly, the industry has not had, prior to this disclosure, a convenient and efficient system of automatically updating fill-time parameters employed in well pumping programs.

In the present disclosure fill-time is determined by a sequence of steps including the following:

(a) pumping the well until it is pumped-off, that is, that further pumping does not produce additional fluids at an economical rate;

(b) delaying further pumping action for a selected uniform short length of time, such as 5 minutes;

(c) initiating pumping action and determining the maximum rod load during a selected portion of the first portion of a downstroke;

(d) stopping the pumping action for another uniform short length of time, such as 5 minutes;

(e) initiating pumping action and determining a new rod load as in step (c) which new rod load will be less than the preceding rod load as the borehole fills. This effect is obtained since the pump on its downward stroke engages the fluid level sooner in the downward stroke as the well fills;

(f) comparing the rod load of step (e) with the rod load of step (c) to determine the quantitative difference; and (g) continuing to repeat steps (c), (d), (e) and (f) until the difference between the new rod load and the preceding rod load is less than a preselected percentage of the preceding rod load.

The elapsed time between step (a) and the end of step (g) is the fill-time for the well.

This disclosure further provides the arrangement wherein the sequence of steps (a) through (g), above-described, are repeated periodically to determine a new fill-time so that as a well is operated, the fill-time is frequently updated automatically. In addition, an important part of this disclosure is the concept of frequently updating the fill-time in a running average arrangement so that a detected new anomalous fill-time will not be employed to the exclusion of the average fill-time which have previously been determined.

A better understanding of the disclosure will be had by reference to the following description and claims, taken in conjunction with the attached drawings.

DESCRIPTION OF THE PREFERRED EMBODIMENTS

Figure 1:
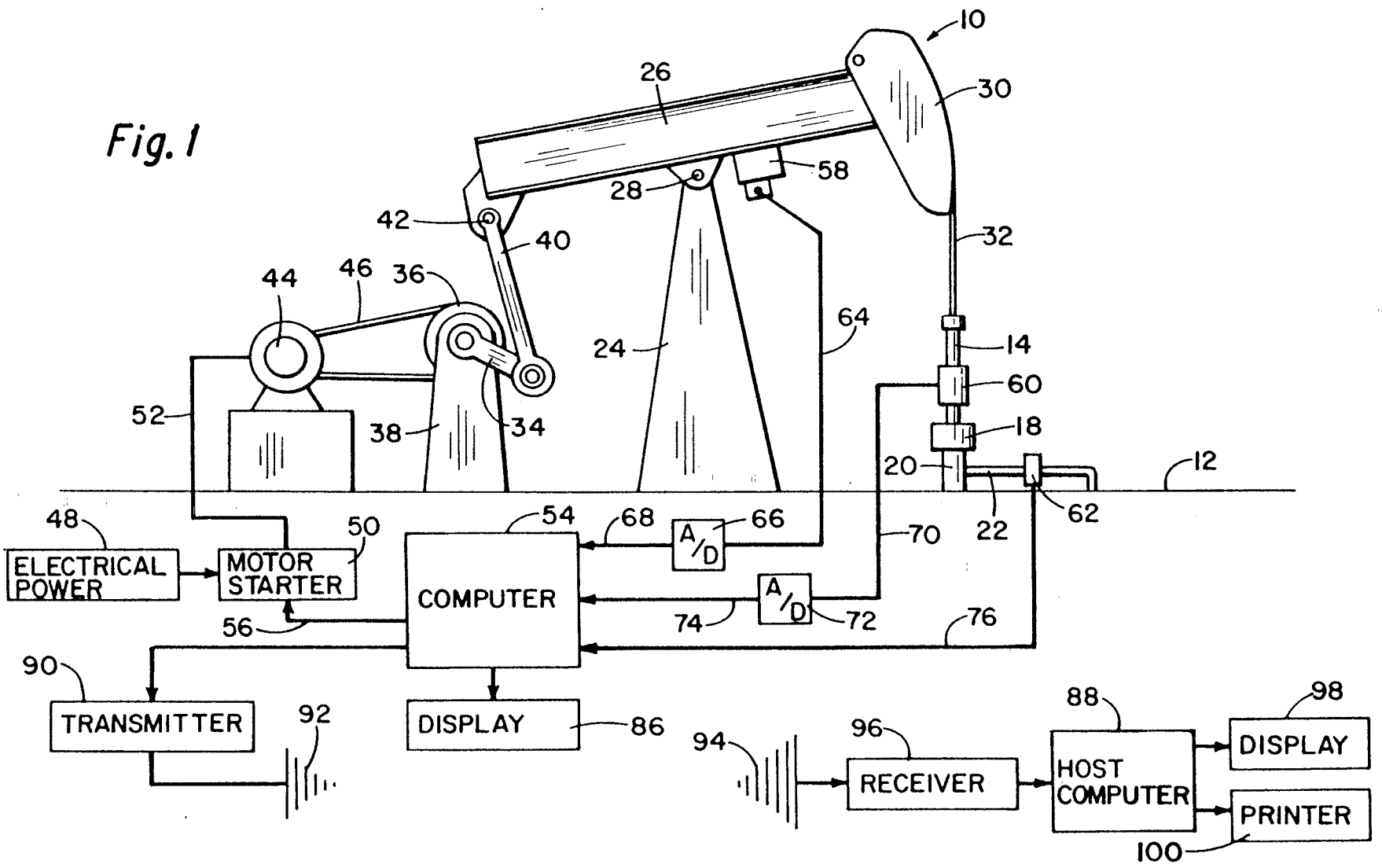
FIG. 1 is a diagrammatic illustration of a well equipped with a pumping unit for sequentially reciprocating a sucker rod string through up and down strokes, and showing in block diagram form equipment used to control the operation of the well pumping unit. The diagram includes the concept of transmitting information regarding the operation of the well by radio signal to a receiver at a host computer so that the activity of a number of wells located in dispersed locations can be monitored at a central location.

Referring to the drawings and first to FIG. 1, a well pumping unit, generally indicated by the numeral 10, is mounted at the earth's surface 12. The purpose of the pumping unit is to reciprocate a string of sucker rods that are suspended from the lower end of a polished rod 14. The sucker rods are reciprocated in a length of tubing (not shown) that extends from a well head 18 to a subterranean pump (not shown). The well head is supported at the top of a string of casing 20 that supports the tubing string. At the lower end of the tubing string within a borehole that penetrates a producing formation (all of which is not shown but which is well-known to any practitioner in the petroleum industry) is a pump having standing valves and traveling valves. Reciprocation of the pump causes fluid from the borehole to be forced up to the surface of the earth. The produced fluid flows out through a collection pipe 22.

The pumping unit 10 is formed typically of a post structure 24 that supports a walking beam 26 at pivotal connection 28. The outer end of the walking beam has a horse head 30 and attached to it are cables 32 connected to the polished rod 14.

The function of pumping unit 10 is to vertically reciprocate polished rod 14 and thereby the sucker rod string (not shown) suspended to the polished rod.

A crank arm 34 extends from a gear box 36 mounted on a support structure 38. The outer end of the crank arm is attached to one end of a pitman 40. The outer end of pitman 40 is connected to the inner end of walking beam 26 at a pivot point 42. As crank arm 34 is rotated by gear box 36, walking beam 26 is pivoted up and down which motion is transferred to horse head 32 and to the sucker rod string.

Energy is supplied to the pumping unit by means of electrical motor 44 having a sheave which receives a belt 46 extending to gear box 36. Electrical power from a source 48, usually from a rural electrical distributing facilities, is applied to motor starter 50. When the motor starter 50 is actuated to a closed position electrical power is supplied by conductor 52 to motor 44 to thereby reciprocate the subterranean pump.

All of the elements described to this point are intended typical representative of the typical oil well pumping unit as found in innumerable locations in the United States and in many countries of the world by which crude oil is pumped from subterranean formations to the earth's surface to flow through the collection pipe 22 for ultimate collection and transfer to a refinery. From this simplified and rather diagrammatically illustrated pumping unit it is easy to understand that substantial electrical energy is required to operate the average pumping unit, and that, therefore, if the well is pumped during times when fluid is not being produced, then significant non-productive energy costs are being expended. In addition, the mechanical equipment required to convert electrical energy into the physical reciprocation of a string of sucker rods is expensive. Unnecessary and unproductive utilization of such pumping equipment is to be avoided. At the same time, it is also easy to understand that if commercial quantities of crude oil exists in the well borehole and the pumping unit 10 is not operated properly to pump the crude oil to the earth's surface, then the total productive capacity of the well is diminished.

Subterranean oil producing formations are typically porous rock structures in which the crude oil slowly migrates through the porous structures to the borehole formed in the earth. As a well gets older and crude oil is being drained from greater distances in the producing formation, longer time is required to fill the borehole. In addition, it is obvious that as a borehole fills an equilibrium level is gradually achieved and once achieved no further fluid flows into the borehole. Further, it can easily be understood that a borehole does not fill at a uniform rate. When a borehole is completely empty, fluid pressure differentials exists between the formation and the boreholes so that fluid migrates into the borehole. As the borehole approaches the equilibrium point, differential pressures decrease and the rate of filling decreases. For maximum efficiency of production, the borehole should never be permitted to achieve full equilibrium since at equilibrium stage all fluid migration toward the borehole is stopped. If the well is pumped so that it is never completely full, migration of fluid in the producing formation toward the borehole is continues at all times. Therefore, in the preferred techniques of pumping fluid from a subterranean formations most producers desire to initiate a pumping cycle when the borehole approaches but has not yet reached equilibrium.

A primary objective of this disclosure is to provide a method of monitoring and controlling a pumped well to achieve (1) maximum fluid production at (2) minimum energy costs. To achieve these goals the first requirements is that, for each pumping cycle, when the borehole has been substantially emptied, the pumping unit is promptly shut down, that is, starter 50 be deactuated to remove electrical energy from motor 44. The second requirement which must be achieved is to provide a means of selecting a period of delay between pumping cycles, referred to as "fill-time", so that each successive pumping cycle starts when the fluid level in the borehole is approaching but is below the equilibrium level.

To accomplish these objectives, three measurements are supplied as inputs to a computer 54. The computer employs appropriate software to be discussed later, provides an output signal on a conductor 56 to control motor starter 50. The first measurement is that which indicates the displacement of the sucker rod string or more particularly the polished rod 14. While this can be done in a variety of ways, an easy method is by the use of an inclinometer 58 affixed to walking beam 26. As crank arm 34 is rotated walking beam 26 is pivoted between a maximum angle at the top of the pump stroke and a minimum angle at the bottom of the stroke. It can be seen that the minimum angle, that is, the bottom of the stroke, is achieved when the crank arm 34 and pitman 40 are in alignment, with crank arm extending in the direction toward the pivot point 42. In the same way, the maximum angle, that is, the top of the stroke, is achieved when the crank arm 34 and pitman 40 are partially parallel to each other, with crank arm 34 extending in the direction away from the pivot point 42. The actual angles measured are not critical as long as the relative angles are obtained from inclinometer 58.

A small percent of wells are pumped with apparatus which do not use a walking beam. In such cases, displacement of polished rod 14 (and thereby the rod string) can be measured in other ways. The principles of this disclosure are applicable to any type of pumping system employing a vertically reciprocated rod string.

The second measurement required is the rod load. This can be measured by load cell 60 placed in series with polished rod 14. The load cell 60 can be affixed at the point of attachment of cable 32 to the polished rod 14 or it may be in the form of a strain gage secured to the polished rod. In any event, the load cell 60 provides, typically, an analog voltage signal proportional to the total load on the rod string.

The third required measurement is obtained from a flow sensor 62 positioned in collection pipe 22. Flow sensor 62 need not be concerned with an accurate measurement of the rate of fluid flow through the collection pipe 22 but is used to provide essentially a flow or no flow signal, that is, a signal which indicates when flow through pipe 22 has terminated. This is called "pumped-off" signal.

The signal from inclinometer 58 is fed by conductor 64 to an analog to digital (A/D) converter 66. A digital signal representing the displacement as indicated by inclinometer 58 fed by conductor 68 to computer 54. In a similar manner, the rod string load is provided as an analog signal from load cell 60 by conductor 70 to an A/D converter 72 and then by conductor 74 to computer 54.

The existence or not of pumped-off condition as detected by flow sensor 62 is applied by conductor 76 to computer 54.

Computer 54 continuously monitors these three parameters, that is, the displacement or beam angle as detected by inclinometer 58; the rod load as detected by load cell 60; and the presence or absence of flow in the collection pipe 22 as detected by flow sensor 62. By means of software within computer 54 which carries out the concepts of this disclosure, the motor 44 is energized at the proper time to initiate a pumping cycle and de-energized at the proper time to terminate the pumping cycle unit.

Figure 2:
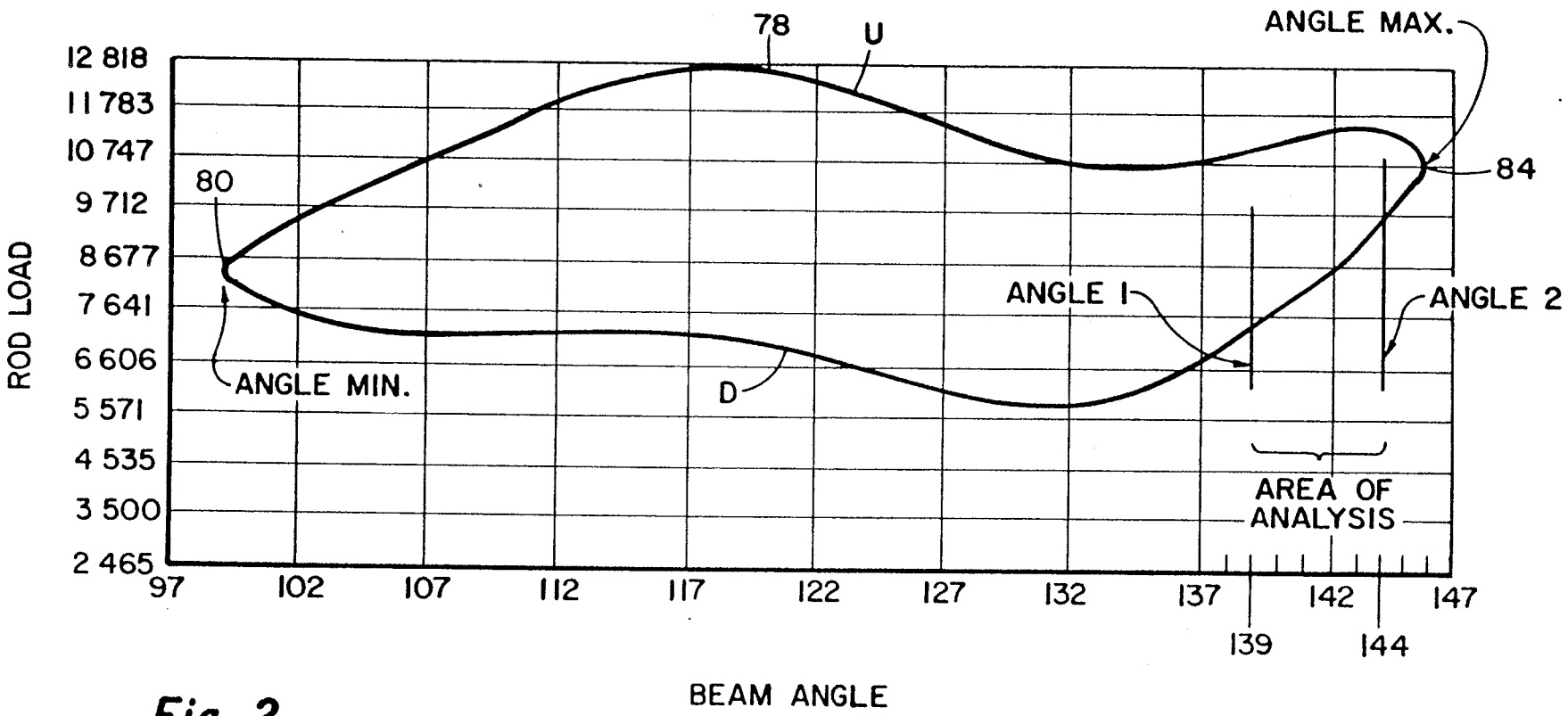
FIG. 2 is a plot of the rod string displacement verses load for one cycle of the normal operation of the well pumping unit, typically referred to as a dynagraph. The chart shows a portion of the first portion of a downstroke, termed the area of analysis, which is used for examining rod load. Such rod load is used both to determine pump off as well as fill-time.
Figure 3A:
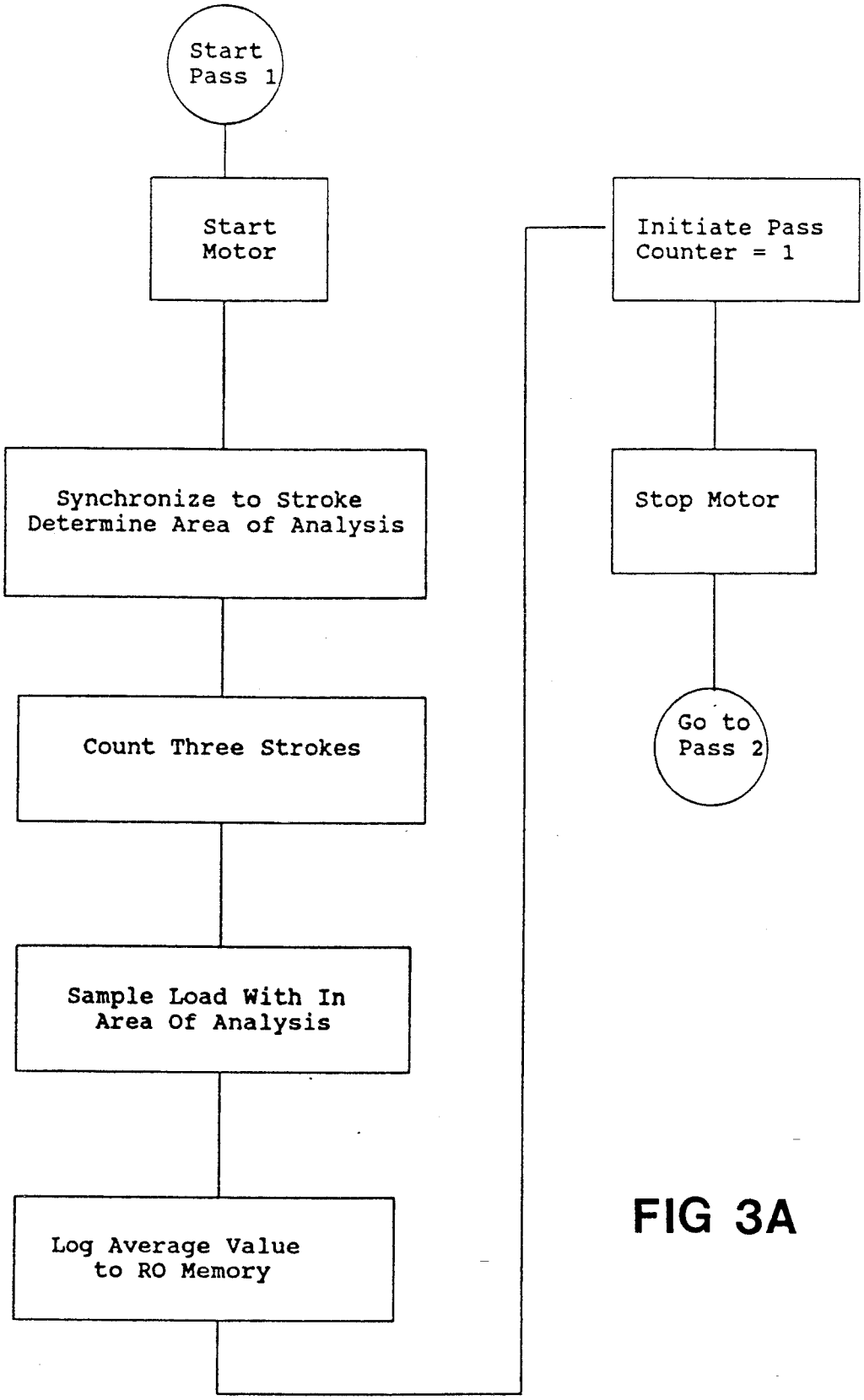
FIGS. 3A through 3I are flow charts of the basic algorithms employed in the pumping unit control of an oil well pumping unit.
Figure 3B:
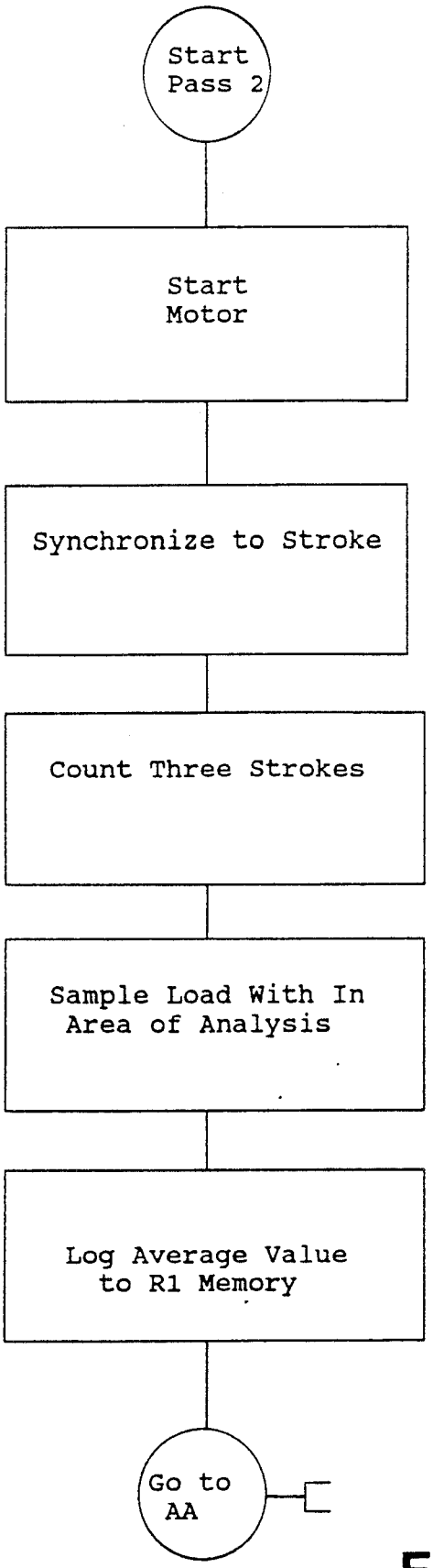
Figure 3C:
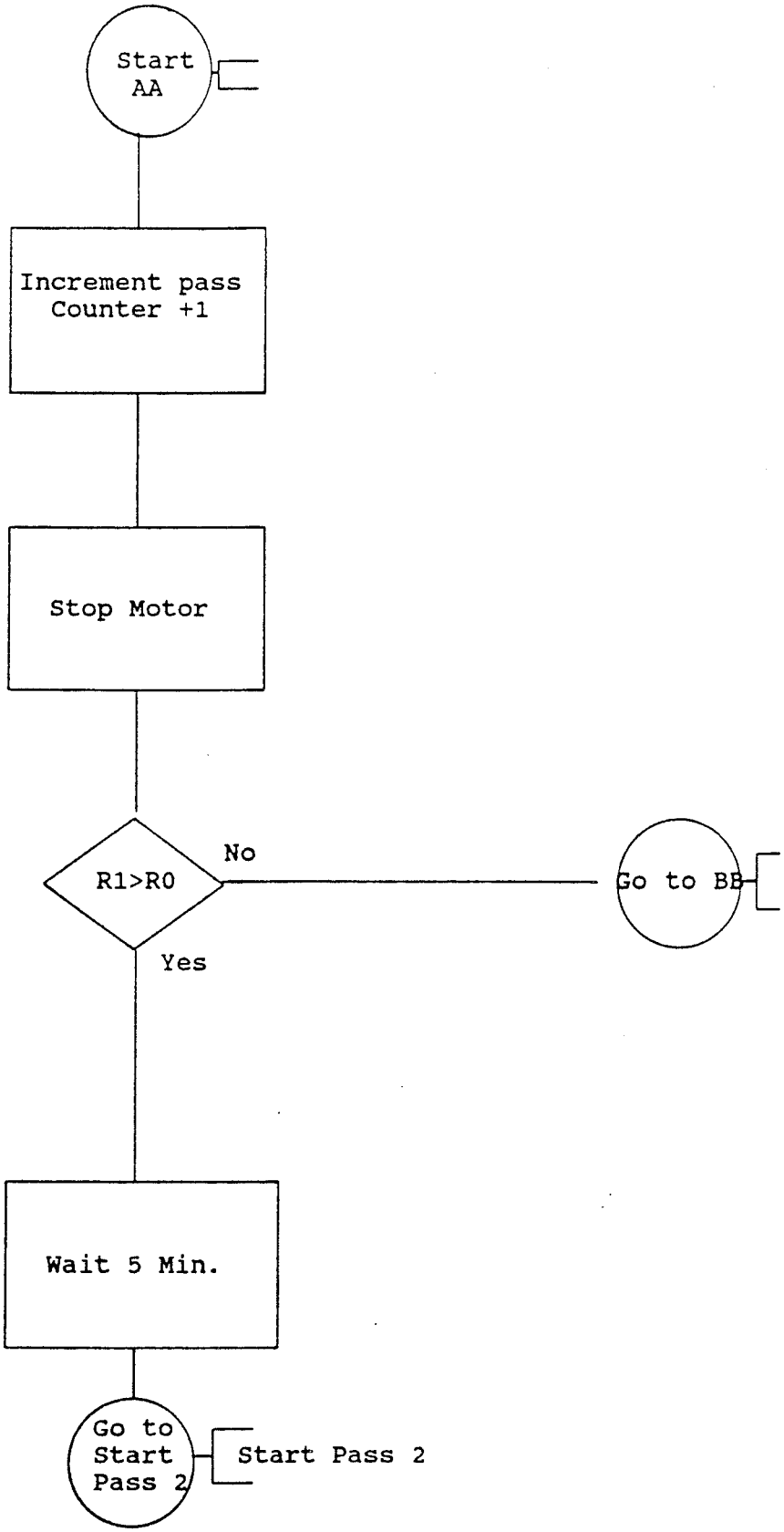
Figure 3D:
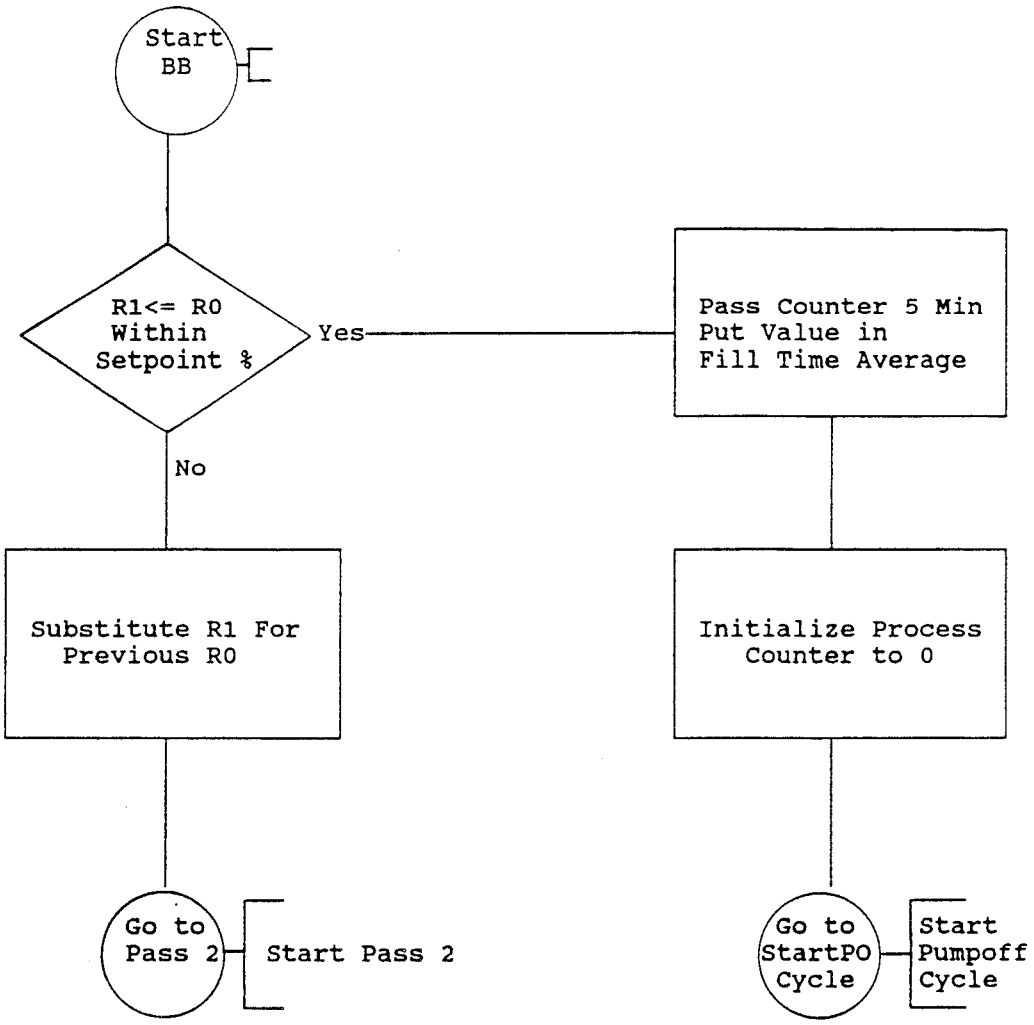
Figure 3E:
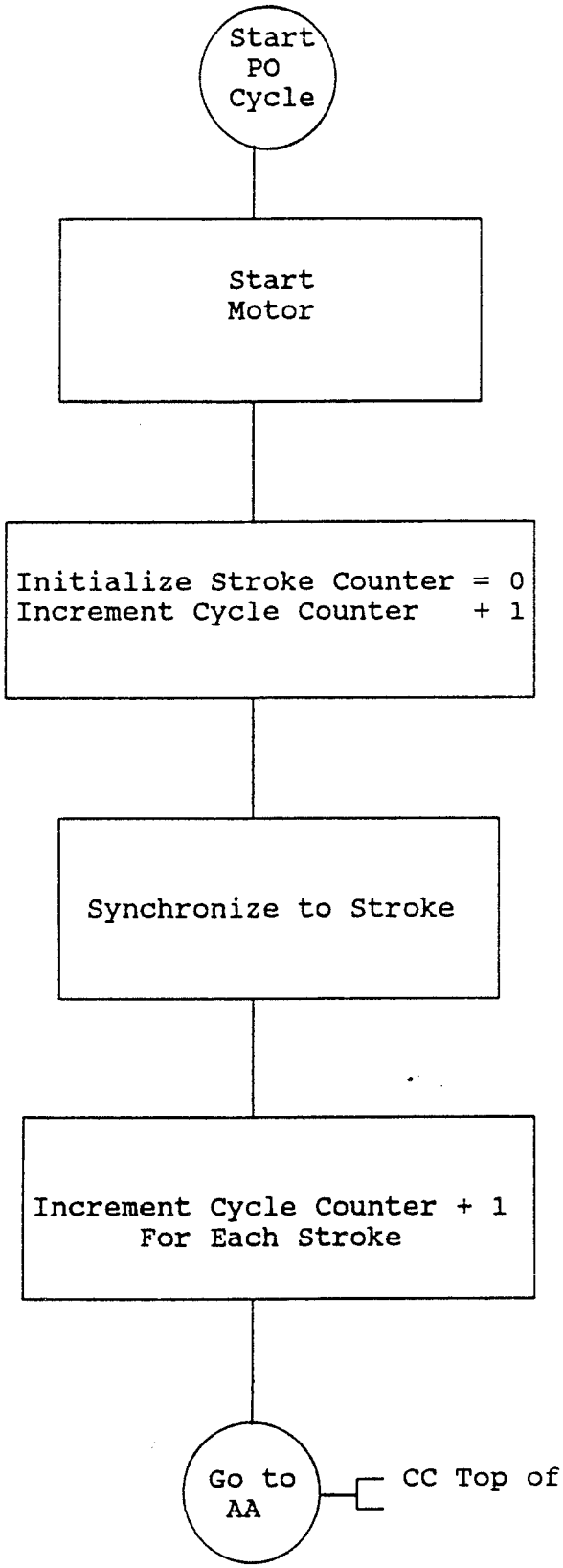
Figure 3F:
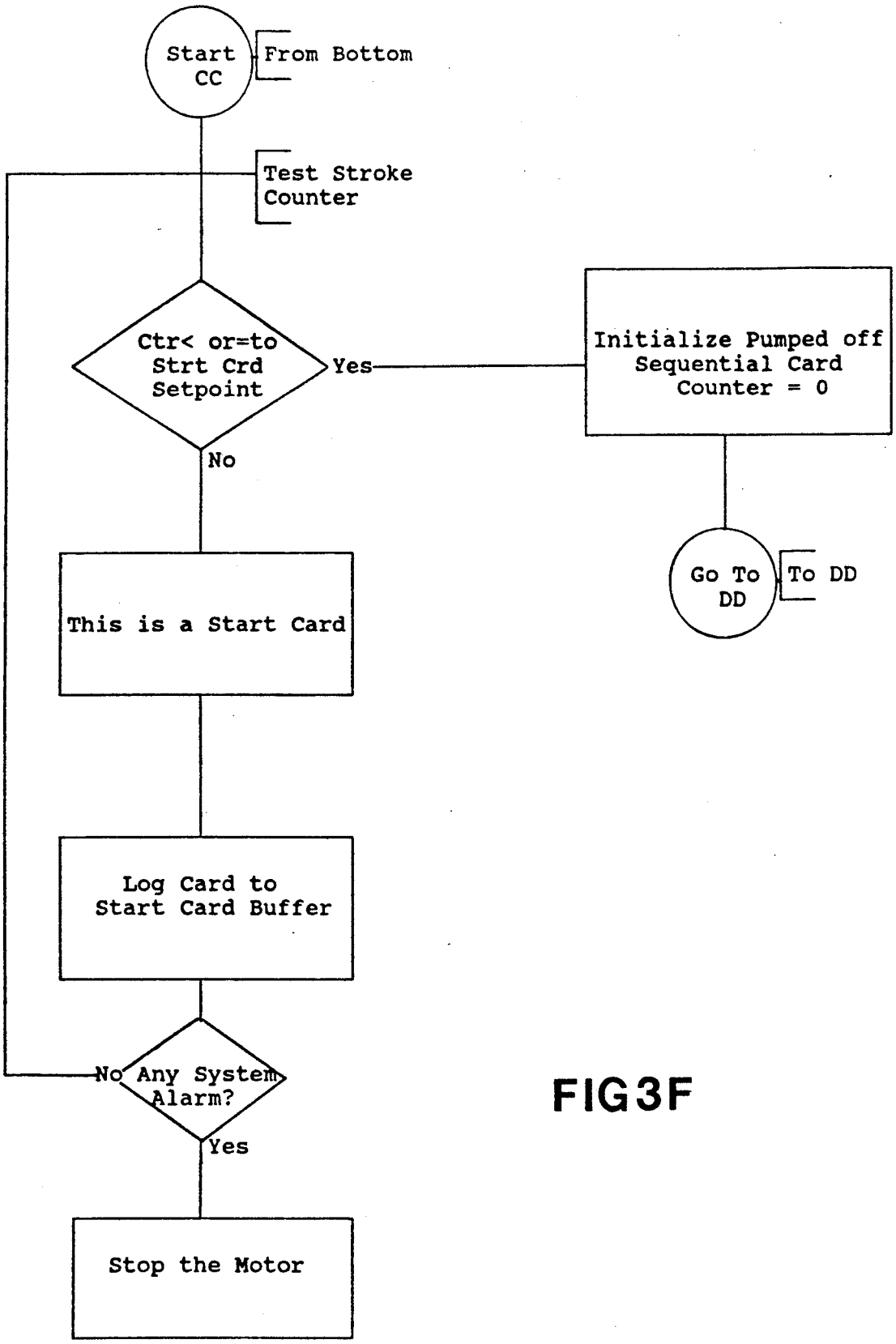
Figure 3G:
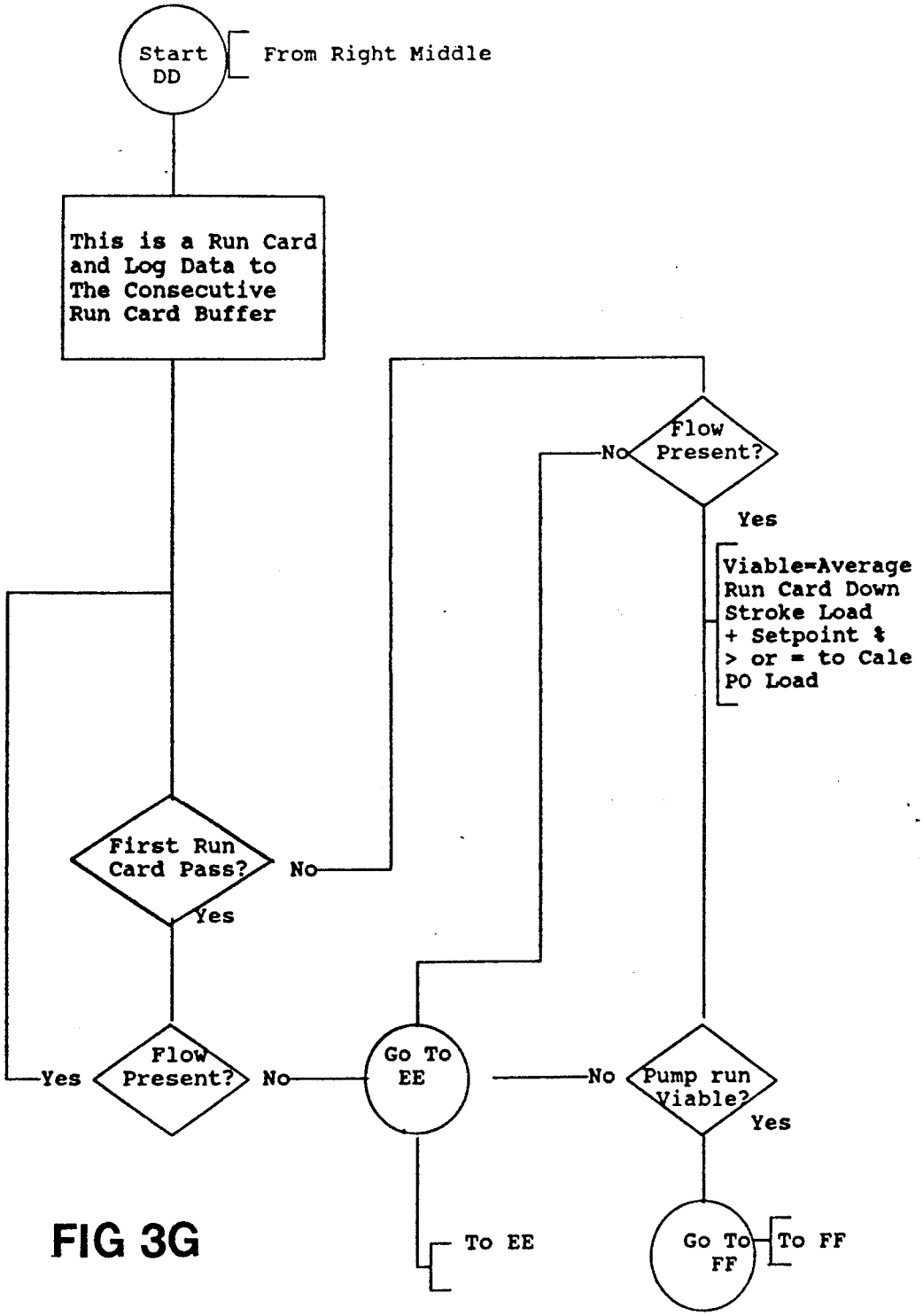
Figure 3H:
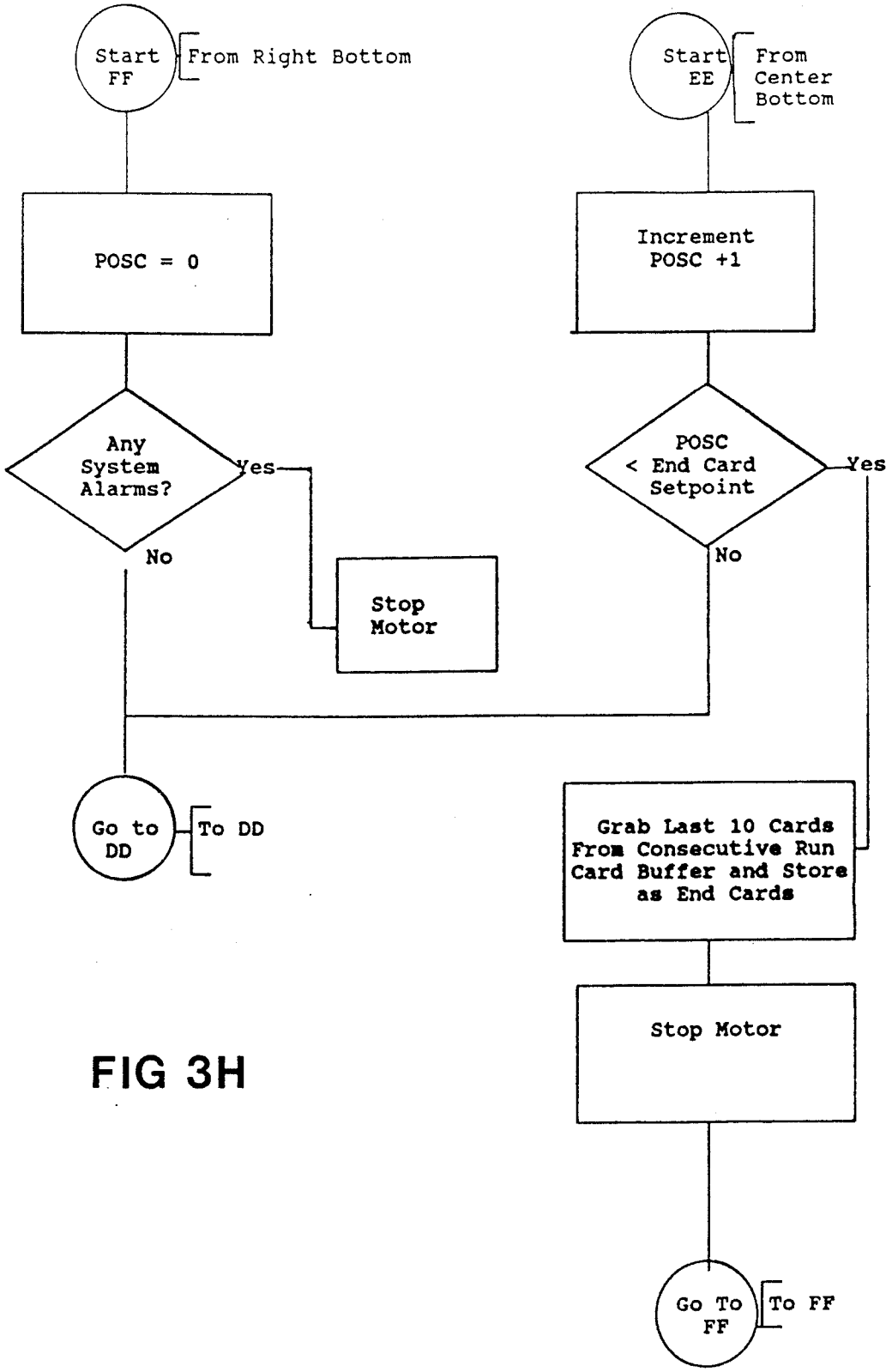
Figure 3I:
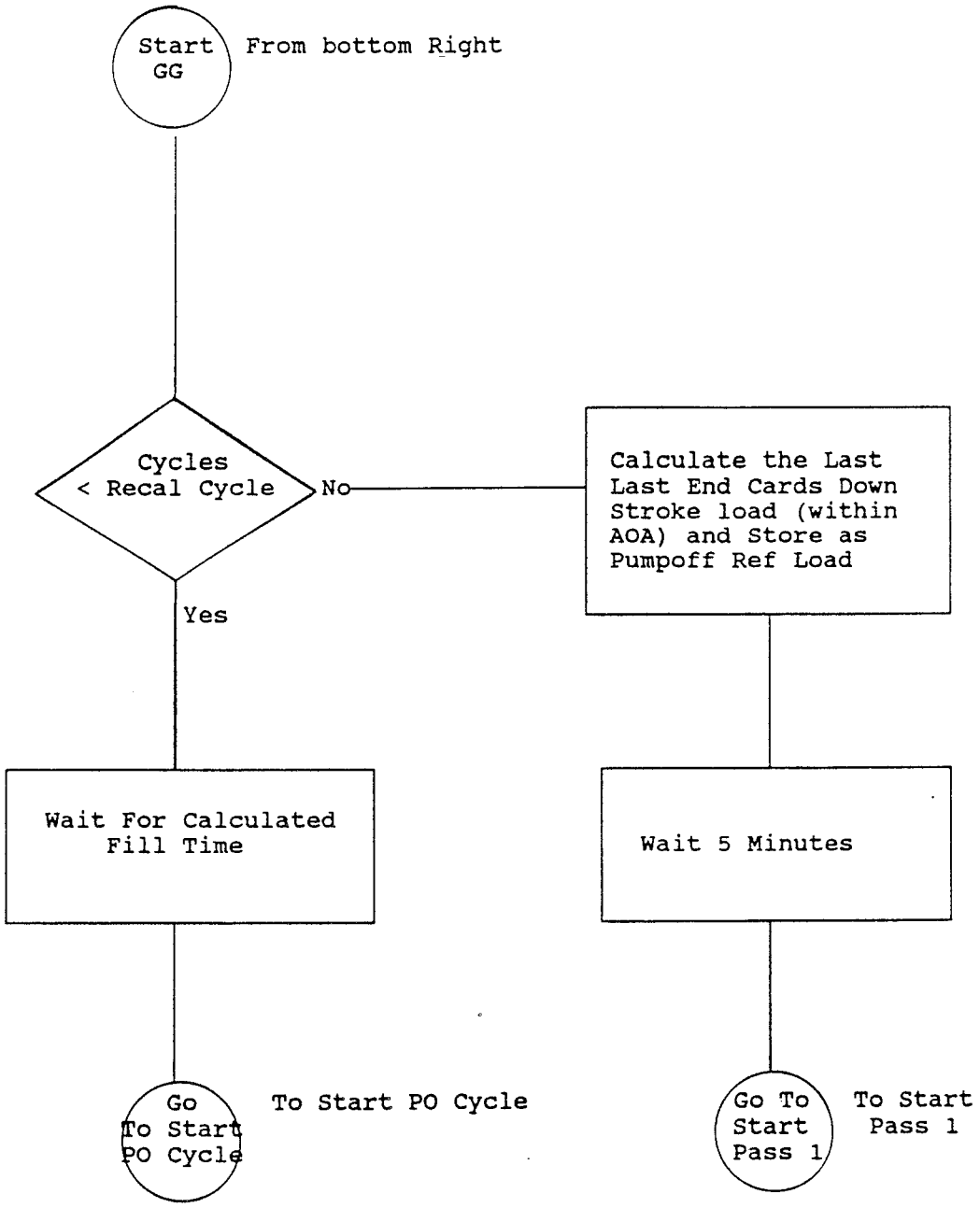

The first time motor 44 is energized to start pumping, the measurement of the highest and lowest beam angle is detected by inclinometer 58 and reported in the computer. The signals provided by inclinometer 58 and load cell 60, when plotted against each other, are pictorially illustrated in FIG. 2. FIG. 2 is what is known traditionally in the petroleum industry as a "dynagraph" of the well pumping unit, showing, as the ordinate, the displacement represented by beam angle, and the rod load as the abscissa calibrated in weight. While dynagraph 78 of FIG. 2 is typical, however, the actual appearance of a dynagraph varies considerably depending upon the type of pumping equipment employed, the depth of the well, the pumping frequency, that is, the number of rotations per second of the crank arm 34, the diameter of the bottom hole pump, the length of stroke of the pumping unit, and many other factors. The dynagraph shows how the load on the rod string as measured by load cell 60 varies, the load being typically much lower on the downstroke than on the upstroke. On one end of the dynagraph, indicated by the numeral 80 and indicated as the minimum angle, is the bottom of a downstroke and the beginning of the upstroke. At the opposite end of the dynagraph and indicated by the numeral 84 is the end of the upstroke, that is also the beginning of the downstroke. The downstroke portion of the curve is indicated by the letter "D", that is, that portion between the end of the upstroke 84 and the beginning of the next upstroke 80. When the bottom of the movement of the horse head 30 is reached and the crank arms starts pivoting beam 26 in the opposite direction, the horse head 30 moves upwardly, lifting the polished rod 14 and the rod string with it, and the upstroke portion increased of the dynagraph is indicated by the letter "U".

By analysis of the dynagraph of FIG. 2, many characteristics of the well can be determined. For the purpose of this section of this disclosure the only characteristic which is required is that of determining when the well has pumped-off, or, more precisely, is substantially approaching the pumped-off condition. To provide calibration for detecting a pumped-off condition, the well is started and pumped for as long as necessary until the borehole is pumped empty of fluid, that is, when further pumping produces no further fluid flow through collection pipe 22. The absence of fluid flow is detected by flow sensor 62, and the information conveyed to computer 54. Within the computer the load on the sucker rod string during a preselected portion of the first portion of a downstroke is utilized to provide a pumped-off signal. This portion of the first portion of the downstroke is indicated in the dynagraph of FIG. 2 as that between angle 1 and angle 2, identified as the "area of analysis." These angles are arbitrarily selected, but may be that angle 1 is about 7 to 15 degrees below the maximum angle at the end of the upstroke 84, and angle 2 is 2 to 5 degrees below the maximum angle at the end of the upstroke. In the example illustrated, the area of analysis is that between angle 2 which is at approximately 144 degrees and angle 1 which is at about 139 degrees. Since the maximum angle is about 146, angle 2 is about 2 degrees below the maximum angle, and angle 1 is about 7 degrees below the maximum angle. These angle selections are arbitrary and may typically be of greater or lesser angles, the only requirement is that an area of analysis is selected which is in the first portion of the downstroke but below and preferably not including the beginning of the downstroke.

With this area of analysis selected and with the well continuing to be pumped during pumped-off condition, the rod load in the area of analysis is detected. By "rod Load" is meant the average rod load detected between angle 2 and angle 1. The computer then derives from such computed rod load a target pumped-off control rod load signal tat is selected as a percentage of the detected rod load in the area of analysis during pumped-off condition. This selected percentage could be such at 90%, although this procedure can vary up or down according to the desires of the well operator.

As the fluid level in the borehole falls as the well is pumped, the average rod load in the area of analysis will gradually increase.

By selecting a pumped-off load condition as being within a certain range, such as 10% of that which actually occurs in full pumped-off, the well is never thereby pumped completely dry. For a variety of reasons some petroleum engineers and practitioners believe that it is undesirable to pump a well until the borehole becomes completely dry. Further, since pumping efficiency diminishes as the fluid level in the well falls, it is not economically practical to pump the well until the borehole becomes completely dry. Therefore, a pumped-off target signal is derived by computer 54. Thereafter, during each pumping cycle the well is considered pumped-off, and pumping action stopped when the average load measured in the area of analysis equals or exceeds the established target average pumped-off load.

In summary, computer 54 controls the action of the pumping unit 10, terminating a pumping cycle in which the following steps are employed:

(1) The displacement of the rod string is measured by inclinometer 58;

(2) The load on the rod string is measured by load cell 60 and computer 54 determines the average load for a selected portion of the first portion (area of analysis) of the downstroke of pumping unit;

(3) The well is monitored by means of flow sensor 62 to determine when the well is pumped-off;

(4) During such pumped-off condition the average load in the area of analysis is determined;

(5) A target average pumped-off load is calculated as a selected percentage of the average pump off load in the area of analysis during pumped-off conditions. This targeted average pumped-off load is stored in the computer;

(6) Thereafter upon the initiation of each pumping cycle the well will be continually pumped, the average load on each downstroke in the area of analysis will be calculated and compared with the established target average pumped-off load; and (7) When the average rod load within the area of analysis equals or exceeds the targeted average pumped-off load, the computer, by signal to motor starter 50, disconnects power from motor 44, stopping the pumping unit. This sequence is repeated for each pumping cycle until a new targeted average pump off load is determined, using the above-identified steps.

The next requirement in controlling a pumping unit is to determine the time spacing between pumping cycles, that is, the length of time the pumping unit is inactive following a pumping cycle before a new pumping cycle is started, which will be hereinafter referred to as the "fill-time".

As has been previously stated, there are two basic criteria for economical and efficient operation of a pumping unit. The first is that of stopping a pumping cycle when the well is pumped-off, or is essentially pumped-off, which has been above described. The second and perhaps more important criteria is that of determining the time between pumping cycles. After the well is pumped-off, that is, the borehole is empty or substantially empty of fluid, time must be allotted for the fluid to migrate from the formation into the borehole and fill or substantially fill the borehole to near the fluid equilibrium point before the next pumping cycle is started. If a pumping cycle is started too soon, that is, before the borehole is substantially filled to the equilibrium point, then pumping cycles that are more frequent than necessary will result. These more frequent than necessary pumping cycles cause increased wear and tear on machinery since the greatest stress on machinery occurs during start-up. Further, when the pumping cycle approaches the pumped-off condition, the pumping efficiency reduces. Therefore, for maximum economy of production, it is desirable that a length of fill-time be established as accurately as possible. If the pumping cycle is not started when the fluid level reaches substantially the equilibrium point but is delayed beyond such time, then the total productive capacity of the well is diminished. It is obvious that the maximum productivity capacity of a well requires the fluid to be removed from the borehole as soon as the fluid level approaches the equilibrium point. For all of these reasons, determining the fill-time is of critical importance, and this disclosure provides, in addition to the improved means of controlling the shutdown of a pumping unit upon pumped-off conditions as heretofore been described, a highly improved means of determining the fill-time.

The first step in determining fill-time is to pump the well until the borehole is empty or substantially empty, that is, until the well is pumped-off. After pumped-off is determined as heretofore described and as detected by flow sensor 62, the well is shut down. Further pumping action is delayed for a uniform short length of time, such as 5 minutes. After this uniform short length of time computer 54 starts the pumping unit and the pumping unit pumps the well through a few strokes, such as three full pumping strokes. During these three pumping strokes, a selected portion of the first portion of the downstroke is determined. This portion determines the area of analysis, such as indicated in FIG. 2, which may be the same or a different area of analysis than that utilized for controlling pump off. Assuming the same area of analysis is selected, that is, assuming that angle 1 and angle 2 are selected for the area of analysis used in determining fill-time, the average rod load within the area of analysis is determined for the last of the three strokes. This rod load average is stored in the computer.

The next step is a second period of delay for a uniform short length of time, the same selected short length of time as for the first period of delay, such as five minutes. After such second five minute delay, by action of the computer, the pumping unit is restarted, and the well is again pumped through three strokes. Obviously, instead of three strokes the number of strokes for each test period could be one, two, three, four, five, etc., but, in any event, some limited small number of strokes is selected for each test cycle. For purposes of description, it will be assumed that the number of strokes is selected to be three. The average rod load in the area of analysis for the last stroke is detected and averaged. The well is then shut down. The two determined values for the average rod load are compared. If the well is in the process of filling, the measurements will reflect this rising fluid level in the borehole, and the value of the average rod load determined for the second test period will be less than that for the first test period. If the second determined maximum rod load is less than the first, the sequence is repeated—that is, a sequence of test are conducted after each short period of delay which, in the example, is five minutes. After the third five minute delay, the pumping unit is started and pumped through three complete strokes with the last stroke's average load measured and stored. As the test sequence is repeated, the average rod load decreases, indicating that the borehole is in the process of filling. This sequence of tests, separated by five minute delay periods, followed by initiating pumping action through three complete strokes is continued until the average rod load within the area of analysis compared to the previous average rod load within the area of analysis is different by a preselected percentage or "deadband". This is, as the borehole fills the detected average rod load within the area of analysis of each test cycle will gradually approach a consistent value, and that value will remain essentially the same as long as the level of fluid in the well is at equilibrium. However, rather than wait until the average rod load within the are of analysis for repeated test cycle are exactly equal, a selected "deadband" is utilized which means that when the last determined average rod load within the area of analysis is not smaller than the preceding average rod load for the preceding test cycle then it is presumed that the reservoir is closely approaching equlibrium. When this determination is made, the determined fill-time is the time which has elapsed since the initiation of the test.

This typical fill-time varies considerably from one well to another and may be as little as one or two hours up to ten to twelve hours or longer. In a well that is known to have a long fill-time the test cycle selected can employ a longer delay between test cycles, such as instead of five minutes in the example given above, test cycle can be ten or fifteen minutes or whatever is selected by the operator. The test cycles need to be of sufficiently short duration to accurately pinpoint the correct fill-time. In summary, the method of detecting the fill-time of a well includes the steps of:

(a) The well is pumped until a pumped-off condition is determined upon which the well is shut down.

(b) Pumping action is delayed for a selected uniform short length of time.

(c) At the end of such short delay computer 54 signals starter 50 to apply energy to motor 44 operating the pumping unit 10 for selected number of full complete strokes (such as three) during which the rod displacement and load is measured, utilizing the inclinometer 58 and load cell 60 as previously described. The average rod load for the last stroke within a selected area of analysis, such as angles 1 and 2 as indicated in FIG. 2, is determined. This average rod load for each stroke is the average rod load for the first test cycle.

(d) After the three strokes, computer 54 stops pumping action for a second uniform short length of time, such as 5 minutes.

(e) After the uniform short length of time, pumping cycle is again initiated by the computer for three full complete strokes and the average rod load is determined as in step (c).

(f) The computer stops the pumping unit. The determined average rod load for the second pumping sequence is compared with that determined for the fist pumping sequence and if he second is less than the first, indication is thereby given that the borehole is filling with fluid.

(g) Steps c, d, e and f are repeated until the difference between the newly determined average rod load and the preceding determined average rod load is less than a preselected percentage of the preceding rod load, indicating that the fluid level is approaching equilibrium.

(h) The time elapsed between that when the well is pumped-of in step (a) and the end of step (g) is determined which time constitutes the determined fill-time.

After a fill-time has been determined utilizing the sequence above, such is stored in computer 54 and utilized to control subsequent pumping cycles. Thereafter, a pumping cycle is initiated, and the pumping unit is actuated until pumped-off condition is determined in the manner as previously indicated and the pumping unit shut down. The computer then delays the next pumping cycle for an amount of time equal to the determined fill-time, after which a new pumping cycle is started. This fill-time is utilized until it is necessary to again determine a new fill-time.

By software programming in computer 54, the system is instructed to determine a new fill-time on a regular bases. For instance, the program in the computer can be arranged such that a new fill-time is computed following every given number of pumping cycles, such as after every 20 pumping cycles. Since computing a fill-time requires frequent starting and stopping the pumping unit, the operator may determine to utilize a selected fill-time for an extended period, such as for 40 to 50 pumping cycles or a new fill-time may be determined on a calendar basis. In any event, the question of how often a fill-time is to be determined is totally within the control of the operator. Obviously, there are advantages in calculating fill-time frequently, so that the operator will know the well is operating in a manner to produce maximum fluid with minimum energy input.

Once a fill-time has been established and utilized, and according to the program in computer 54 a new fill-time is required, the determined fill-time can be logged in a FIFO (First In First Out) buffer of a selected number of values. For instance, the FIFO buffer may be selected to include 10 values. In this manner when a new fill-time is established it is logged in the buffer, and the fill-time employed can therefore be the average of all of the fill-time logged into the buffer. This arrangement has the advantage that if an anomalous fill-time is determined, such as in an extremely long or an extremely short one compared with those previously determined. Such will not materially effect the fill-time used for the next sequence of pumping cycles. At the same time, by utilizing the average of the last 10 determined fill-times, the system includes means for automatically and continuously upgrading the accuracy of the fill-times to account for changing conditions. Within this scheme the greatest amount of change from one fill-time to the next is 1/n, with n being the number of samples in the buffer, such as 10.

Basic algorithms employed in computer 54 to provide the steps of well control described herein for control of pumping unit 10 are illustrated in FIGS. 3A through 3I.

Referring again to FIG. 1, a display 86 may be located at the well site in conjunction with computer 54 so that the operating conditions of the well can be readily available to an operator on site. The displayed information can include the length of each pumping cycle or the average length of the last n number of pumping cycles. In addition, display 86 may display the fill-time either as the last determined fill-time or the average fill-time of the last n number fill-time. It can be seen that much additional information can be displayed to aid the operator in evaluating the conditions of the well.

The information provided by the system of this disclosure is important for each well in a producing field. Utilizing a remotely located host computer 88 provides a way for the operating characteristics of a large number of wells to be monitored. To provide the information to the host computer a transmitter 90 having antenna 92 transmits by radio frequency the information to a receiving antenna 94 at the site of the host computer 88. The transmitted information is conveyed to receiver 96 and then to the host computer, wherein the information for individual wells or for the total field may be provided by display 98. Permanent records can be provided. These records provide indication of changing characteristics of the field and are exceedingly useful for operators in managing a field for maximum production at lowest operating costs.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of controlling a pumped well having a rod string extending from a pumping unit located at the earth's surface to a subterranean pump, the rod string being sequentially reciprocated through up and down strokes, the well producing pumped fluid flowing from the well through a collection pipe, the method comprising the steps of:

(1) measuring the displacement of the rod string;

(2) measuring the load on the rod string through a selected portion of the first portion of the downstroke;

(3) monitoring the fluid flow through the collection pipe to determine when the well is pumped-off;

(4) recording the load on the rod string detected in step (2) during pumped-off conditions;

(5) establishing a target pumped-off as a selected percentage of the load recorded in step (4);

(6) periodically imitating a pumping cycle; and (7) terminating each pumping cycle when the load detected in step (2) equals or exceeds the established target pumped-off load obtained in step (5).

2. A method of monitoring and controlling a pumped well according to claim 1 wherein said rod string is reciprocated by a pumping unit having a pivotally supported beam, and wherein step (1) of measuring the displacement of the rod string includes measuring the angle of pivotation of the beam.

3. A method of controlling a pumped well according to claim 2 wherein said selected portion of the first portion of the rod string downstroke step (2) is determined in an area of analysis between a selected first and a selected second angle of beam pivotation.

4. A method of controlling a pumped well according to claim 2 wherein said rod load is determined as the average rod load within an area of analysis between a selected first and s selected second angle of beam pivotation.

5. A method of controlling a pumped well according to claim 2 wherein said selected portion of the fist portion of the rod string downstroke of step (2) is determined between selected angular portions of the maximum angle at the top of the rod string upstroke.

6. A method of controlling pumped well according to claim 1 wherein in step (5) the target pumped-off load is about 90% of the load recorded in step (4).

7. A method of controlling a pumped well according to claim 1 wherein in step (6) the initiation of a pumping cycle is determined by the lapse of a determined length of time from the time of termination of a pumping cycle in step (7).

8. A method of controlling a pumped well according to claim 7 wherein the length of time between pumping cycles is determined by fill-time of the well.

9. A method of controlling a pumping well according to claim 1 wherein the length of each pumping cycle is stored for use in evaluation of well performance.

* * * * *